United States Patent [19]

Haddock

[11] 4,027,434

[45] June 7, 1977

[54] EDGING APPARATUS FOR OPHTHALMIC LENS

[75] Inventor: Fred A. Haddock, Muskogee, Okla.

[73] Assignee: Coburn Optical Industries, Inc., Muskogee, Okla.

[22] Filed: July 15, 1975

[21] Appl. No.: 598,491

Related U.S. Application Data

[63] Continuation of Ser. No. 364,287, May 29, 1973, abandoned.

[52] U.S. Cl. ..... 51/101 LG

[51] Int. Cl.[2] ..... B24B 13/00

[58] Field of Search ..... 51/101 LG, 100 R, 284, 51/241 R; 90/139, 62; 74/569; 33/23 H, 23 K; 318/645

[56] References Cited

UNITED STATES PATENTS

| | | | |
|---|---|---|---|
| 2,597,686 | 5/1952 | Turner et al. | 33/23 H |
| 3,015,768 | 1/1962 | Hornfeck | 318/645 |
| 3,170,374 | 2/1965 | Clar | 51/101 LG |
| 3,555,739 | 1/1971 | Novak | 51/101 LG |
| 3,771,265 | 11/1973 | Bright | 51/101 LG |
| 3,786,600 | 1/1974 | Bloxsom | 51/101 LG |
| 3,899,851 | 8/1975 | Asselin | 51/101 LG |

*Primary Examiner*—Al Lawrence Smith
*Assistant Examiner*—Nicholas P. Godici
*Attorney, Agent, or Firm*—John J. Byrne; Edward E. Dyson

[57] ABSTRACT

A follower travels the inside contour of a rotating eyeglass frame and the movement caused by changing radii is detected by a linear variable differential transformer and converted into electrical signals which actuate an electrically operated valve. The valve, in turn, controls the movement of a hydraulic cylinder which dictates the positioning of a lens blank to be edged relative to the grinding periphery of an abrading wheel taking into account the position of the lens edge on the abrading surface.

13 Claims, 8 Drawing Figures

EDGING APPARATUS FOR OPHTHALMIC LENS

This is a continuation application of Ser. No. 364,287, filed May 29, 1973 now abandoned.

BACKGROUND OF THE INVENTION

1. Field of the Invention

This invention relates to lens forming equipment and, more particularly, to an improved, automatic lens edge grinder. The invention is specifically directed to an attachment for lens blank edging equipment. A frame follower senses the inside contour of a spectacle frame and transmits its sensings to beveling equipment to thereby eliminate the need for patterns or templates for each lens configuration.

2. Description of the Prior Art

Typical prior art edging machines employ patterns or templates in the shape of the inside contour of an eyeglass frame socket for controlling the duplication of the lens edge in an ophthalmic lens edging machine. Each different lens configuration required a different pattern. The patterns for each and every lens size or style had to be catalogued and stored for later use.

Some prior art devices have been developed which have mechanisms to follow the inside contour of a frame for the purpose of duplicating this contour on the edge of the lens to be ground. One such device is disclosed in U.S. Pat. No. 3,572,855 to Charles R. Bright. The Bright device includes a plurality of U-shaped, air and vacuum-biased cam means which detect the contour of the frame. Such an approach can introduce errors into the lens grinding operation due to the finite number of measurements which are taken about the periphery. Other interesting teachings include the United States patent to Clar U.S. Pat. No. 3,170,374, Feb. 23, 1965, and to Novak, U.S. Pat. No. 3,555,739, Jan. 19, 1971. Each of these teachings utilizes the interior of a frame socket to form a corresponding periphery.

SUMMARY OF THE INVENTION

According to the present invention, a new and improved device accurately forms the edges of ophthalmic lenses according to the inside contours of the frames to which they are ultimately mounted.

A frame follower traverses the inside contours of a frame socket as the frame is rotated and transmits information describing its movement of the frame follower into electrical signals reflecting its location. Signals from a LVDT control a valve governing the actuation of a hydraulic cylinder which engages the pattern contact plate of a conventional lens edging machine.

Accordingly, it is an object of this invention to provide an improved lens frame sensing attachment for lens edging equipment.

Another object of this invention is to provide an attachment for a conventional ophthalmic edging machine which eliminates pattern cams for sizing and shaping lenses to fit into a spectacle frame.

A further object of this invention is to provide an improved lens frame sensing attachment having a single sensor directly engaging the inside periphery of an eyeglass frame to thereby control the duplication of a lens edge in a lens edging machine.

Another important objective of the present invention is to provide a sensitive but rugged attachment for accomplishing the aforementioned objectives.

These and other objects and advantages of this invention will be more fully understood upon a reading of the following specification taken in view of the attached drawings.

BRIEF DESCRIPTION OF THE DRAWINGS

The present invention may be more fully appreciated by referring to the accompanying drawings in which.

DESCRIPTION OF PREFERRED EMBODIMENT

Figure 1:
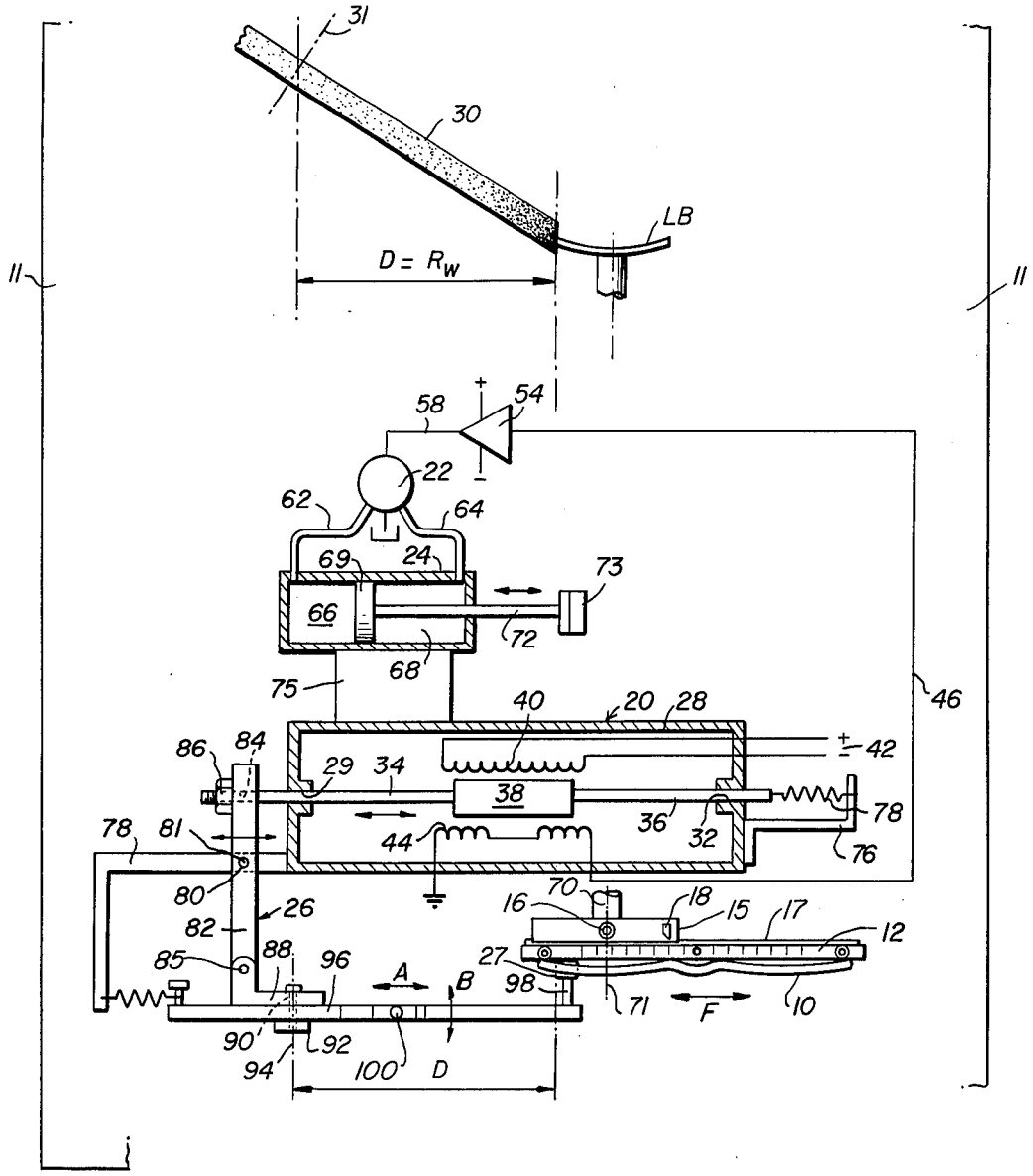
FIG. 1 is a schematic plan view showing certain relationships with the equipment to which it is mounted.

Referring now to the drawings wherein like numerals indicate like elements, the numeral 10 indicates a spectacle frame mounted on a frame carrier 12. The carrier 12 is mounted onto a semi-dovetail adapted driver plate 15 which in turn is mounted to a lens carrier shaft 70 of an edging machine and rotates in unison therewith. The apparatus of this invention is conveniently used with that type of edger displayed in the aforementioned Bright patent or with the edger disclosed in the Gray et al U.S. Pat. No. 3,121,979 issued Feb. 25, 1964. In this latter patent (See FIG. 13 thereof), a template 72 is mounted at the end of the lens chuck shaft 70 and rotates therewith. The pattern is juxtaposed adjacent the bearing surface 73 and the lens blank to be ground is caused to move toward and away from the abrading wheel 30 in accordance with the periphery of the template. In the instant invention, mechanism is provided for replacing the pattern 72 with the spectacle frame itself. The abrading wheel, the chucking shaft, and the bearing surface are indicated, respectively, by the numerals 30, and 70 and 73 which numerals correspond to their corresponding elements in the Gray patent. In FIG. 1, the numeral 11 indicates a bevel edger to which the apparatus of this invention is mounted.

Figure 2:
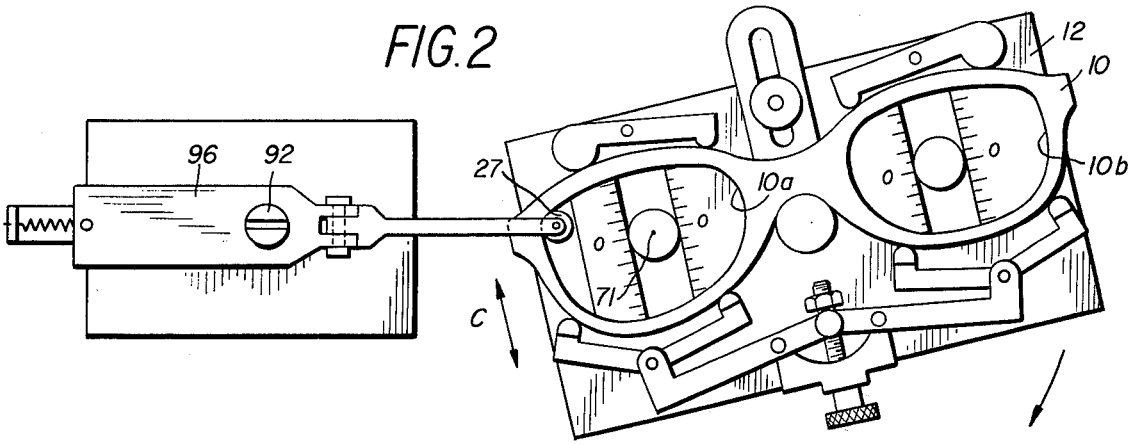
FIG. 2 is a side view of a frame follower mechanism.

The chucking shaft of a conventional bevel edger has a pair of pins at its outer end to receive the patterns that are equipped with apertures to receive the pins. This aids in aligning the base and cross curve axes of the pattern with that of the blank to be ground. Carrier 12 is equipped with a sliding dovetail bar 17 which attaches to a driver plate 15 which in turn is attached to chucking shaft 70. This arrangement allows the position of the eyeglass frame to be easily adjusted relative to shaft 70. Shaft 70 is properly adapted to fit the pins of a conventional edger pattern holder. Carrier 12 is also equipped with numbered indicia for properly aligning the optical centers of the contours **10*a* and 10*b* with the mechanical center of the chucking shaft. The axis of driver 15 is pre-adjusted so that dovetail bar 17 properly locates each frame axis as carrier 12 is mounted to driver 15. The scales shown within contours 10*a* and 10*b* are provided to properly align the frame center to the shaft axis 71 in the vertical plane as indicated by Letter C, FIG. 2. The numbered indicia located at the upper edge of carrier 12 are used to align the base center of the frame to center of shaft 70. This is accomplished by adjusting carrier 12** as indicated by F, FIG. 1, until the scale on carrier 12 is properly aligned with marker 18. This adjusts the frame in the horizontal plane. Carrier 12 is then locked to driver 15 by locking knob 16, thus securing dovetail 17 and accurately controlling the axis of the frame to the shaft. The lens to be ground, of course, also has its optical center aligned with the axis of rotation of the shaft 70.

As viewed in FIG. 1, it can be seen that shaft 70 carries a lens blank L in close proximity to the grinding edge of the abrading wheel 30. As shown, the abrading wheel 30 is canted with respect to the chucking shaft 70. This is common practice when a bevel is to be placed on the periphery of a blank. However, it should be understood that in many edgers the axis of rotation 31 of the abrading wheel is parallel to the axis 71 of the chucking shaft.

While it may be desirable to cant the abrading wheel 30 with respect to the chucking shaft 70, it is necessary that the cutting edge of wheel 30 remain parallel to the axis of center line 71. In this manner, a smooth and flat bevel can be generated around the perimeter of lens blank LB.

As stated above, the optical center of the lens socket 10*a* is mounted to the chucking shaft 70 in a manner that its optical center is coaxial with axis 71 of the chucking shaft. The same is true for the lens blank L. It also should be understood that the cross and base curves of the lens blank are properly aligned with socket 10*a*.

In carrying out this invention, four principal components are used; namely, a linear variable differential transformer 20, an electrohydraulic servovalve 22, a hydraulic cylinder 24 and a parallelogram linkage indicated generally by the numeral 26.

The housing 28 of the LDVT 20 is mounted to the bevel edger 11 at a location so that the linkage 26 can position its follower wheel 27 in engagement with contour 10*a*. Housing 28 is formed with bearings 29 and 32 which respectively receive the arms 34 and 36 which support a core element 38 therebetween. The core 38 is disposed between a primary winding 40 which is connected to an electric source 42. The secondary core 44 has one end connected to ground and its other end 46, connected to the input terminal of an operational amplifier 54. Amplifier 54 is of a type using bias supplies of plus and minus 12 volts DC. The line 58 from the amplifier is connected to an electrohydraulic servovalve 22. The electrohydraulic servovalve is of a conventional type having the ability to convert electric signals into hydraulic power. The servovalve is equipped with two outlet lines 62 and 64 which are connected respectively to the chambers 66 and 68 of the hydraulic cylinder 24. Reciprocally received in the hydraulic cylinder 24 is a piston 69 having an arm 72 mounted for engagement with the cam surface 73. The movement of piston 69 is dependent on the output from the servovalve. It is the movement of piston arm 72 which duplicates the signals of the pattern or template 72 of the Gray patent. The connection between the LDVT 20 and the cylinder 24 is shown diagrammatically in FIG. 1 by the numeral 75.

From the above, it can be seen that a movement of core 38 will signal servovalve 22 to control the position of arm 72. It is the linkage assembly 26 which positions core 38 so as to accurately reflect the contours of socket 10*a*.

Note that as the frame revolves around axis 71 and the contour of the frame socket changes the position of roller 27 relative to axis 71, the linkage 96 and 26 also repositions core 38 relative to housing 38. As that happens, a signal voltage is imposed upon amplifier 54 which causes the servovalve to reposition piston 69 and thus actuator arm 72. The movement of cam 72 against cam 73 causes cylinder housing 24 to be shifted, carrying with it linkage 75 and LDVT housing 28, thus restoring the original relationship between housing 28 and the core 38 and bringing the signal or error voltage again to zero. By this means, the device always seeks a zero output signal.

A pair of brackets 76 and 78 are fixed to the ends of housing 28. The bracket 76 provides a mounting for a spring 78 extending between the bracket and the end of arm 36. The other bracket 78 is apertured at 80 to receive a pin 81 about which an arm 82 can pivot. One end of arm 82 has an opening 84 to receive the outer end of arm 34. The outer end of arm 34 is threaded to receive an adjusting nut 86. The nut is used to initially locate the core 38 against the bias of spring 78. A leg 88 of arm 82 is apertured at 90 to receive a pivot pin 92 having an axis 94. Leg 88 also pivots at pin 85 as illustrated in FIG. 1 to give free lateral movement B, as well as the angular attitudes illustrated in FIGS. 3A, 4A, and 5A. Thus, the lateral movement of leg 88 takes into consideration the toric curve of the frame. It is important that pin 85 be located precisely in alignment with wheel 27. This will assure accuracy through the operating range of Arc B. Mounted about pin 92 is arm 96 which carries the sensing wheel 27 at its outer end about a pin 98. The arm 96 has a horizontal pivot means 100 intermediate its length. This permits the arm segment 96*a* to swing in a horizontal plane to accommodate easy loading and unloading of frames. This pivot does not interfere with the important horizontal linear movement of the arm 96 or with its pivoting motion about axis 94 of pin 92. Note that the sensing arm has limited freedom to move in three dimensions.

Prior to describing operation, certain geometrical relationships will be explained. As seen in FIG. 1, the distance between the periphery of wheel 30 and axis 31 is indicated by the letter D. The extension of axis 94 intersects the axis of rotation 31 of abrading wheel 30. If abrading wheel 30 is not angularly disposed, the axis 94 is coaxial with 31. This relationship is important because of the manner in which a lens contacts the abrading wheel especially upon entering or leaving unusual peripheral configurations of the lens blank to be ground. This is best explained by referring to FIGS. 3, 4, and 5.

The horizontal plane through the center of abrading wheel 30 is indicated by the numeral 102. If the lens blank were circular, the point of engagement between the lens L and the periphery of the abrading wheel would be in this plane. However, very few modern ophthalmic lens are ground with a circular periphery. Modern lens L shown in FIGS. 3*b*, 4*b*, and 5*b* is characterized by a relatively flat area 104 and a curvilinear segment 106. For the purpose of illustration it will be presumed in FIG. 3*b* that the periphery 106 has been in engagement with the abrading wheel and the grinding is about to take place at the curve corner 108. As corner 108 approaches the wheel, the point of engagement of the lens will rise above plane 102 as shown in FIG. 3*b*. As the corner is traversed, the point of engagement between the abrading wheel and the lens will tend toward plane 102 as seen in FIG. 4 *b*. As corner 110 approaches the wheel, the point of engagement of the lens will rise above plane 102 as shown in FIG. 3*b*. As the corner is traversed, the point of engagement between the abrading wheel and the lens will tend toward plane 102 as seen in FIG. 4*b*. As corner 110 approaches the wheel for grinding the point of engagement will drop below the plane 102 as shown in FIG. 5*b*.

If the arms 96 were confined to a horizontal plane an erroneous signal would be transmitted to the linear variable unit 20.

Figure 3A:
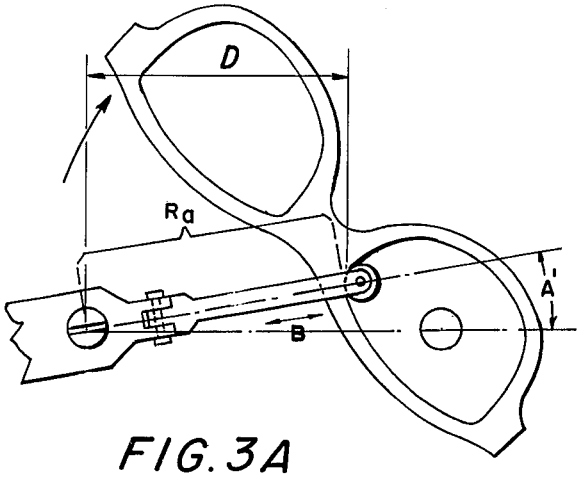
FIGS. 3A, 4A, and 5A are a series of side views of the frame follower and spectacle frame in a variety of different angular attitudes.
Figure 3B:
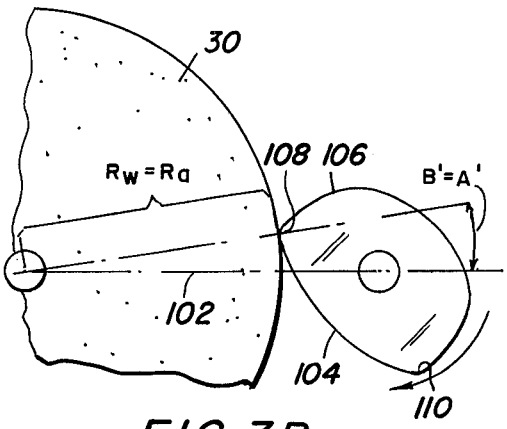
FIGS. 3B, 4B, and 5B are a series of side views of the abrading wheel in contact with the lens blank in positions respectively corresponding to the positions of the follower in FIGS. 3A, 4A, and 5A.

For instance, referring to FIG. 3*a*, the arm 96 is shown locked in a horizontal position although the lens blank L has its periphery engaging the abrading wheel above the plane 102. A signal transmitted to the core 43 corresponding to the distance D would be sent to the linear variable unit 20 by the parallelogram linkage 26. However, by permitting the wheel 27 to ride up and down with respect to 102 and in exactly the same fashion as the point of engagement between the lens and the abrading wheel, a true position between the wheel 27 and the periphery 10*a* is sent to the arm 96. Since the distance D is the same as the effective periphery of the wheel indicated by the letters Rw, an accurate signal will be transmitted.

In operation, the spectacle frame 10 is mounted to the carrier 12 which in turn is mounted to an adaptor, which then is connected to the end of the chucking shaft in the aforementioned aligned position. The wheel 27 is inserted into the female bevel of the frame. The abrading wheel and the shaft 70 are then caused to rotate. As the radii of contour 10*a* changes the arm 96 will be caused to move laterally in the linear direction. The arm 96 will reciprocate in the direction of the arrows A and B. This will cause the arm 82 to pivot about pin 81 and pin 85 and transmit movement to core 38 corresponding to the movement of wheel 27. The signal from the transformer is fed to the hydraulic servovalve 22 which activates the hydraulic cylinder 24 and imparts a movement in piston arm 72 corresponding to the movement of wheel 27 in the horizontal direction. In this manner, a lens edge is ground with a contour directly similar to the female socket of eyeglass frame 10.

Figure 4A:
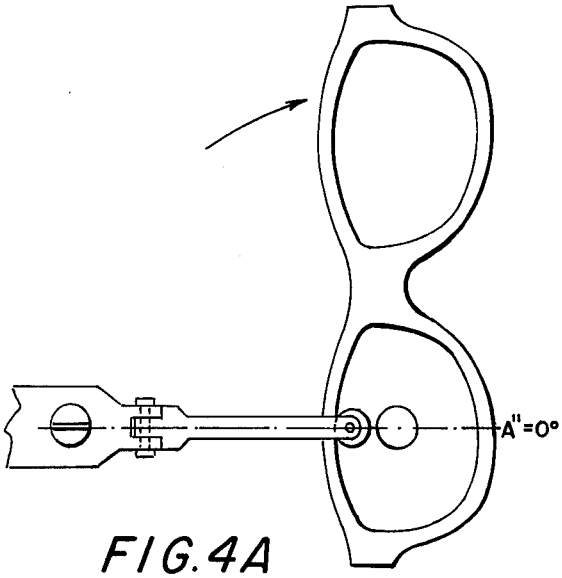
Figure 4B:
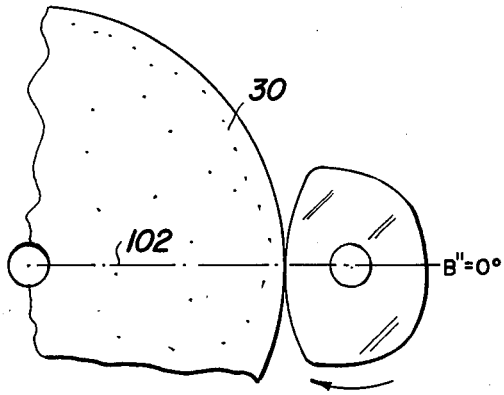
Figure 5A:
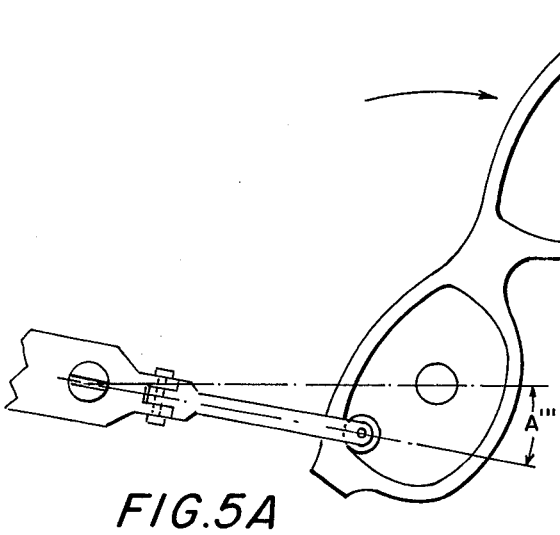
Figure 5B:
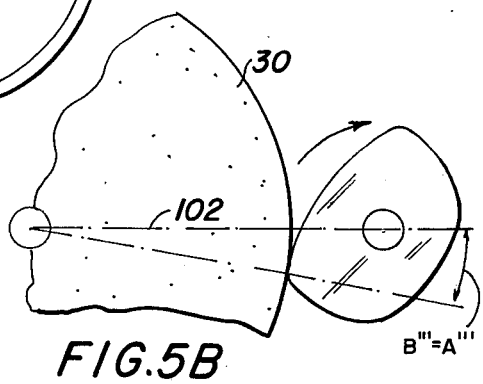

In FIGS. 3A, 4A, and 5A, the angle between the horizontal plane and arm 96 is shown as being A′, A″, and A‴, respectively. Likewise, in FIGS. 3B, 4B, and 5B, the angle between plane 102 and the line from the center of the abrading wheel to the point of contact 108 as illustrated as being B′, B″, and B‴, respectively.

It has been found desirable to keep angle A equal to angle B. By preserving this relationship it is possible to grind the lens blank at the same point that is being detected within the eyeglass socket of frame 10. This makes for better duplication of the contour of the eyeglass frame on the lens blank. It has been found through experimentation that angle A can be kept equal to angle B for all practical values of A by making the radius Ra of arm 96 equal to the effective projected radius Rw of the abrading wheel. In summary, the relationship $Ra = Rw$ means that angle $A$ = angle $B$ for all values of A. FIGS. 4A and 4B illustrate the situation in which center angle A″ is equal to 0°. FIG. 4B shows that when angle $A'' = 0°$ angle $B''$ also equals 0°. Similarly, in FIG. 5A, when large Ra equals Rw, angle $A'''$ = angle $B'''$. Angle A equals angle B when radius Ra equals Rb.

In a general manner, while there has been disclosed an effective and efficient embodiment of the invention, it should be well understood that the invention is not limited to such embodiment as there might be changes made in the arrangement, disposition, and form of the parts without departing from the principle of the present invention as comprehended within the scope of the accompanying claims.

I claim:

1. An automatic lens grinder for forming the edge of an ophthalmic lens to be received inside an eyeglass frame socket comprising, a frame follower pivotally mounted at a point for tracking the inside contour of said eyeglass frame socket as said frame is rotated, an electronic sensor for detecting the movement of said frame follower and for converting said movement into electrical signals proportional to the displacement of said frame follower, an electrically operated valve responsive to said electrical signals for controlling a fluid output, an actuator responsive to said fluid output, a grinding wheel for shaping the peripheral contour of said ophthalmic lens, and means to rotate said lens with said socket and second means causing said follower to follow in said socket the corresponding point of contact that said lens makes with said grinding wheel.

2. The automatic lens grinder of claim 1 wherein said electronic sensor comprises a linear variable differential transformer.

3. The automatic lens grinder of claim 1 wherein said fluid is a hydraulic fluid.

4. The automatic lens grinder of claim 1 wherein said fluid is air.

5. The automatic lens grinder of claim 1 wherein said electrically operated valve is servo-operated and includes two output ports adapted for direct connection to said actuator.

6. The automatic lens grinder of claim 5 wherein said actuator comprises an elongated cylinder with each of said output ports connected to opposite ends, said actuator further including a piston within said elongated cylinder responsive to said fluid output.

7. The automatic lens grinder of claim 1 wherein said bevel edge grinder includes an abrading wheel of defined radius Rw for grinding said ophthalmic lens.

8. The automatic lens grinder of claim 1 wherein said frame follower has a radius Ra defined as the effective distance between said pivot point and the point of contact of said frame follower with said eyeglass frame socket.

9. The automatic lens grinder of claim 8 wherein radius $Ra$ = radius $Rw$.

10. An automatic lens grinder for forming the edge of an opthalmic lens to be received inside an eyeglass frame socket comprising, a frame follower pivotally mounted at a point for tracking the inside contour of said eyeglass frame socket as said frame is rotated, said frame follower comprising, a support, a first member pivotally connected to said support for pivotal movement in a first direction, a second member pivotally connected to said first member for pivotal movement in said first direction, a third member pivotally connected to said second member for pivotal movement in a second direction perpendicular to said first direction, and a following member connected to said third member for tracing the inside contour of said eyeglass frame socket, an electronic sensor for detecting the movement of said frame follower and for converting said movement into electrical signals proportional to the displacement of said frame follower, an electrically operated valve responsive to said electrical signals for controlling a fluid output, an actuator responsive to said fluid output, a grinding wheel for shaping the peripheral contour of said opthalmic lens, and means to rotate said lens with said socket and second means causing said follower to follow in said socket the corresponding point of contact that said lens makes with said grinding wheel.

11. The automatic lens grinder of claim 10 wherein said third member includes a pivot means for disengaging said following member from said frame.

12. The automatic lens grinder of claim 10 wherein said third member is spring-biased against said support.

13. The automatic lens grinder of claim 10 wherein said following member comprises, a spindle connected to said third member, a wheel connected to said spindle for engagement with the inside rim of said eyeglass frame socket, and wherein said wheel includes a pliable rim means for smoothly detecting the inside contour of said frame socket.

* * * * *